United States Patent [19]

Schwing

[11] Patent Number: 4,681,022

[45] Date of Patent: Jul. 21, 1987

[54] TWO-CYLINDER VISCOUS LIQUID PUMP WITH PIPE SWITCH

[75] Inventor: Friedrich Schwing, Gelsenkirchen, Fed. Rep. of Germany

[73] Assignee: Friedrich Wilh. Schwing GmbH, Fed. Rep. of Germany

[21] Appl. No.: 779,162

[22] Filed: Sep. 23, 1985

[30] Foreign Application Priority Data

Sep. 25, 1984 [DE] Fed. Rep. of Germany ..... 3435052
Jul. 5, 1985 [DE] Fed. Rep. of Germany ..... 3524033

[51] Int. Cl.[4] ..... F04B 7/00

[52] U.S. Cl. ..... 91/471; 74/105; 74/106; 137/625.45; 417/516; 417/532

[58] Field of Search ..... 137/625.45; 91/471; 417/900, 516, 517, 518, 519, 532; 74/105, 106, 516, 520, 96

[56] References Cited

U.S. PATENT DOCUMENTS 3,027,155 3/1962 Paterson ..... 74/106 X
3,109,457 11/1963 Oliveau ..... 137/625.45
3,254,660 6/1966 Ray ..... 74/105 X
4,297,908 11/1981 Zimmer ..... 74/106
4,337,017 6/1982 Evenson ..... 417/516
4,382,752 5/1983 Schlecht ..... 417/900 X

*Primary Examiner*—Edward K. Look
*Attorney, Agent, or Firm*—Andrus, Sceales, Starke & Sawall

[57] ABSTRACT

In a two-cylinder viscous liquid pump with a pipe switch, which by means of a swing pipe alternately connects one of the pump cylinders with the conveyor pipe and releases the other pump cylinder, and which swing pipe is moved along its path of travel by a sliding pin drive via a rocking shaft at varying speeds, powered by one or more hydraulic cylinders, the invention provides a link in the transmission of motion from the drive output to the sliding pin drive, which link serves to change the distance of the connecting element of the sliding pin drive to the axis of the rocking shaft, going from a maximum distance at the beginning and end of the link travel to a minimum distance at the center of the link travel.

7 Claims, 6 Drawing Figures

TWO-CYLINDER VISCOUS LIQUID PUMP WITH PIPE SWITCH

Figure 1:
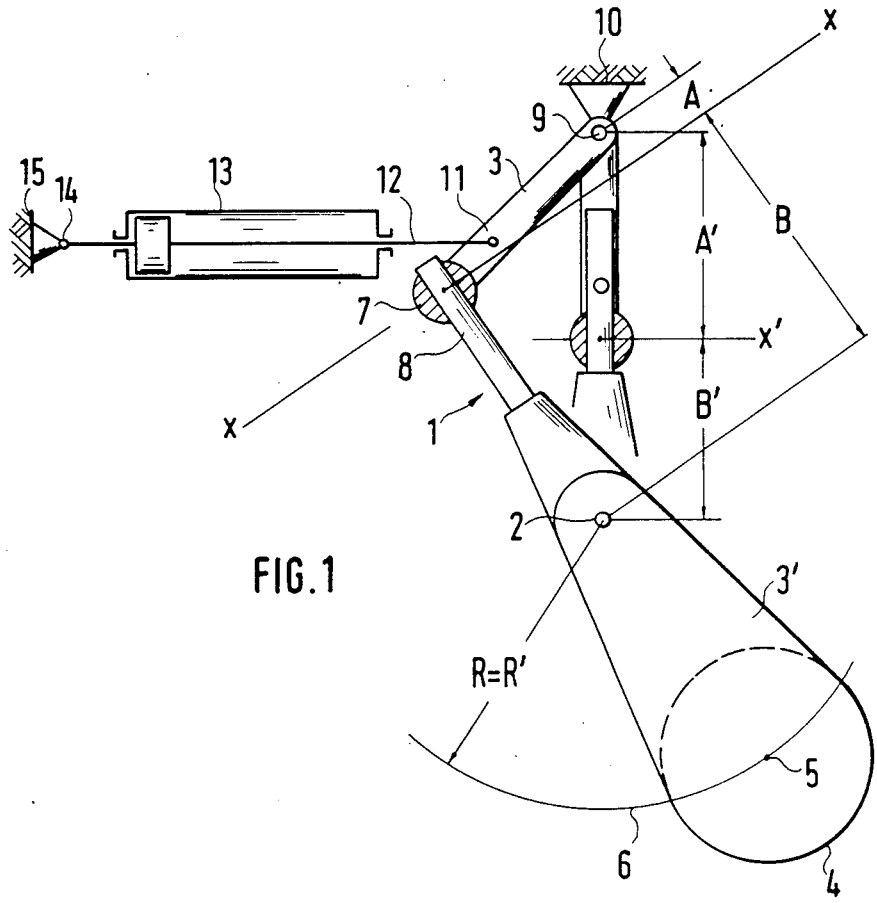

The invention concerns a two-cylinder viscous liquid pump. In particular, the invention pertains to this type of concrete pump.

The method of operation of such pumps is such that the viscous liquid to be conveyed is drawn in with the back stroke of one of the pump cylinders; thus, this cylinder is filled mostly from a so-called preliminary feed container. With the forward stroke of the other pump cylinder, the previously drawn-in viscous liquid is pushed into the conveyor line. It is the function of the pipe switch, at the stroke change, to separate the previously conveying cylinder from the conveyor line and to connect the other pump cylinder, which is filled with the previously drawn-in viscous liquid, to the conveyor line. For this purpose, the swing pipe of the pipe switch travels a swing path in each of the two possible directions, respectively. The ends of the swing pipe open with one or the other pump cylinder. Driving the swing pipe by means of one or more working cylinders via a sliding pin drive means possible the direct transformation of the reciprocating motion of the cylinder piston rods, which serve as the output, via the shuttling swing motion of the slide into the curved path which is traveled by the swing pipe—which is connected to the sliding pin drive—during its swinging motion.

According to the invention, the working cylinders operating the sliding pin drive are preferably driven hydraulically and controlled in such a way that there results within them an essentially uniform piston speed through the power stroke. Since, according to the inventon, the pump cylinders in the viscous liquid pump, in turn, are preferably driven by hydraulic drive cylinders which can normally be acted upon only when the pipe switch has traveled through its path, the hydraulic working cylinders of the pipe switch can be switched into a single-circuit system of the hydraulic plant and thus be acted upon by the same pressure source which also takes care of the hydraulic drive of the pump cylinders. However, the invention can also be used with two-circuit systems, which provide separate pressure sources for driving the swing pipe and the pump. This makes it possible to create the conditions for the time limitation of switching action of the pipe switch, which on the one hand determine the uniformity of conveying the viscous liquid through the conveying line and which, on the other hand, determine the conveying capacity. Of course, these characteristics are determined by the total interruption of the pumping action between the working strokes of the pump cylinders, and this interruption results not only from the swinging time which the swing pipe requires between the strokes, but also results, among other things, from the equalization of the short volume resulting from the volumetric suction effect, as well as from the return-flow of viscous liquid from the conveyor line, which must likewise be equalized; however, the return-flow, too, depends on the swinging time.

The return flow of the viscous liquid is due to the fact that the swing pipe is not covering one of the cylinder openings of the pump after the swinging action has begun and the alignment of the swing pipe with the opening of the conveying pump cylinder no longer exists until alignment with the pump cylinder which is filled by the suction stroke. This can be countered mainly by shortening the swinging time of the swing pipe. On the other hand, the geometric proportions of the sliding drive result in undesired side effects even when the swing pipe speed is only relatively low. This is because the sliding pin drive accelerates the swing pipe, depending on the size of the swinging angle, toward the end of the swinging motion in both directions, if the piston speed of the working cylinder which drives the swing pipe is kept approximately constant over the swinging range of the swing pipe. The consequence is rough operation of the pipe switch, together with considerable dynamic stresses on its elements and the machine components which interact with them.

The invention starts with an already known two-cylinder viscous liquid pump (DE-OS No. 32 53 576). Here, an electro-hydraulic control of the pump drive cylinders and the working cylinders of the pipe switch is to assure that the hydraulic pump which generates the pressure has a favorable effect on the time which passes between the end of the piston movement in the conveying cylinder until the start of the pumping action of the other pump cylinder during the swinging movement of the swing pipe; the pump works with varying absorption quantities above zero in the opposition direction with synchronous operation of the working cylinder of the swing pipe, which is driven via the main circuit or a second hydraulic circuit, and the fact that this working cylinder is hydraulically coupled with the working cylinders of the hydraulic pressure generator is meant to make this favorable influence on swing time possible. Thus, the conveying volume of the hydraulic medium is linearly reduced to zero in the first half of the switching process, and in the second half it is linearly increased in the opposite direction to the maximum conveying volume. However, in addition to the above described hydraulic short volumes due to suction, another hydraulic short volume results in the drive cylinders of the pump cylinders, which considerably increases the pumping interruption time. Generally this does not result in appreciable speed differences of the pistons in the working cylinders of the swing pipe and of the swing pipe during its path of travel. Consequently, the harmful dynamic stresses occurring during the movement of the swing pipe still have to be accepted.

It is the object of the invention, in order to reduce the dynamic stresses and thus to decrease the return flow of the viscous liquid from the conveying lines between the ends of the swinging motion, to reduce the residual force of the swing pipe at the ends of the swing path with short swinging time, thereby improving the degree of uniformity with which the viscous fluid is conveyed through the conveying line.

According to the invention the speed of the swinging movement of the swing pipe is maintained positively by means of a non-slip drive, independent of the hydraulic pressurizing of the working cylinder; this drive consists at least of the sliding pin drive, the output of the working cylinders of the swing pipe, and at least one additional link added by the invention. In this drive the speed of the swinging movement is continuously changed by changing the distance ratios of A/B over A'/B' in A/B. As opposed to known swing pipes, the swing pipe of the invention's viscous liquid pump has a multiply increased swinging time in the central portion of the swing path than in the end positions, in which the speed can be reduced to a fraction of the average swing pipe speed.

The invention has the advantage that the total switching time of the swing pipe can be kept extremely short, as opposed to comparable swing pipes. As a result of the uneven speed distribution across the swing path, the swing pipe opening at the pump cylinder end passes the central position, which is unfavorable for the return flow of the viscous liquid from the conveying line, about twice as fast as usual, for example, so that consequently the volume of viscous liquid flowing back from the line is reduced to about $\frac{1}{4}$. This is due to the squared dependence of the path of travel, or the volume, on the time, with constant acceleration of the line content. On the other hand it is possible to reduce the swinging speed at the ends of the swing path to, for example, $\frac{1}{3}$ of the average speed of the swing pipe speed. Thus the residual force of the swing pipe is reduced to 1/9 at arrival in the end position, which results in considerable reduction of stress and wear. Finally, the forces at the swing pipe are inversely proportional to the speed. Consequently, the forces in the end positions increase to three times the average forces number the conditions described above. This corresponds to the practical requirements after safe switching of the swing pipe, which among other things requires the breaking of stones when conveying concrete.

Preferably, when applying the characteristics of the claimed invention, the drive should be designed with the minimum number of drive components.

However, the drive also makes it possible to travel considerable swinging angles, which can be achieved with the characteristics of the embodiment of the invention shown in FIG. 1

Likewise, it is not necessary to use only pivoting components in the drive. Turning motions over any swinging angle can be achieved with the characteristics of the embodiment of the invention shown in FIG. 3.

Figure 2:
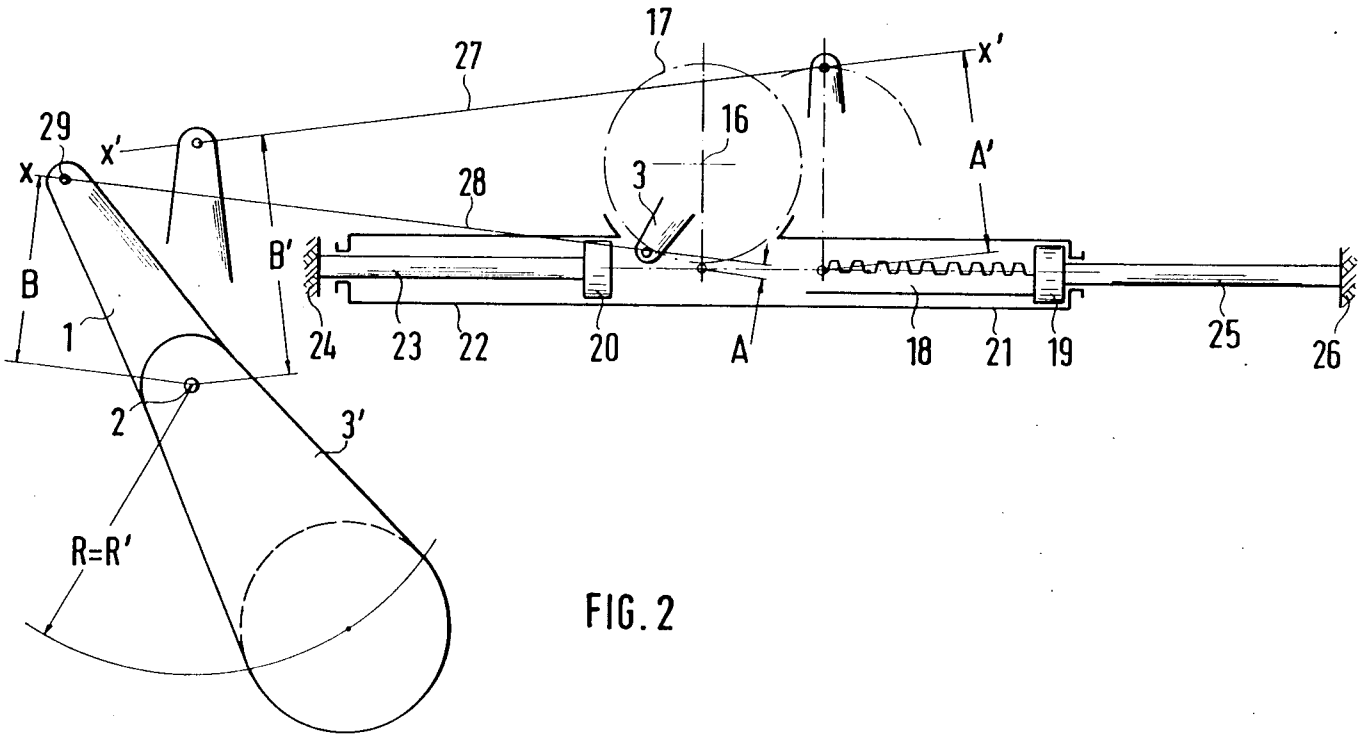

By using the characteristics of the embodiment of the invention shown in FIG. 2 one can assign a separate working cylinder to each direction of the swinging movement.

The characteristics of the embodiments of FIGS. 2, 3, 4, and 5 make possible a substitution of the sliding guide of the connecting elements according to FIG. 1, or other suitable constructions or alternatives with varying space conditions.

The details of the invention can be seen in the following description using several construction examples, which are shown in the drawings.

Figure 3:
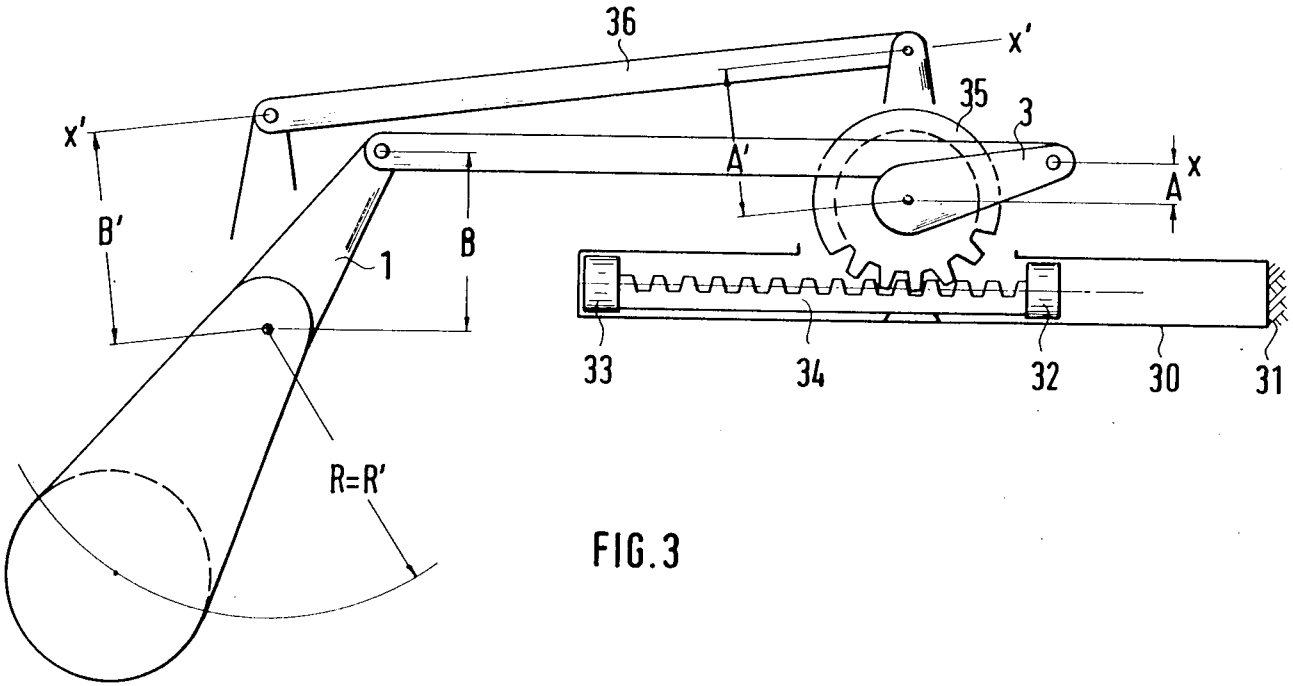
Figure 4:
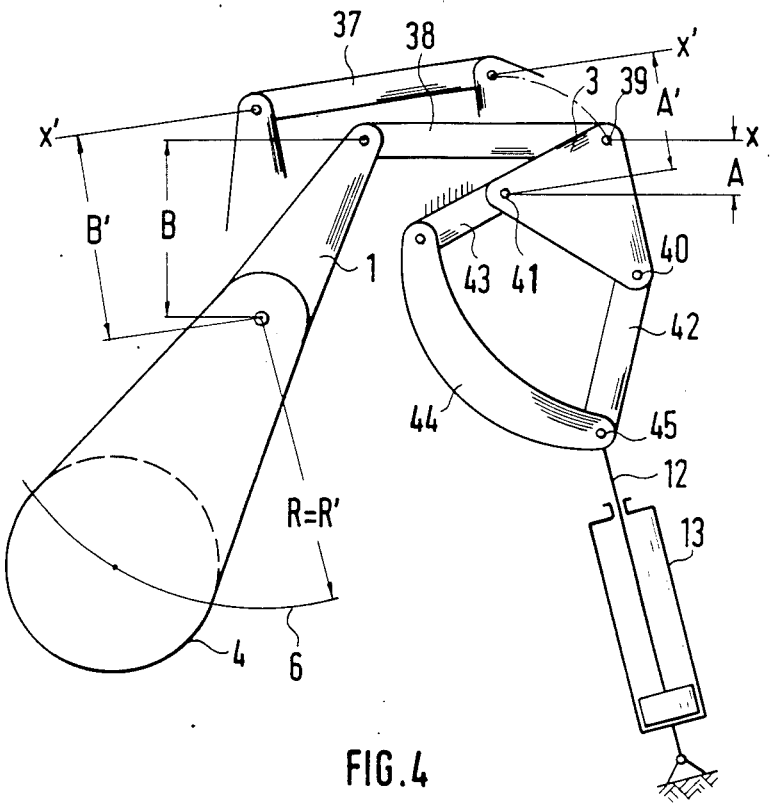
Figure 5:
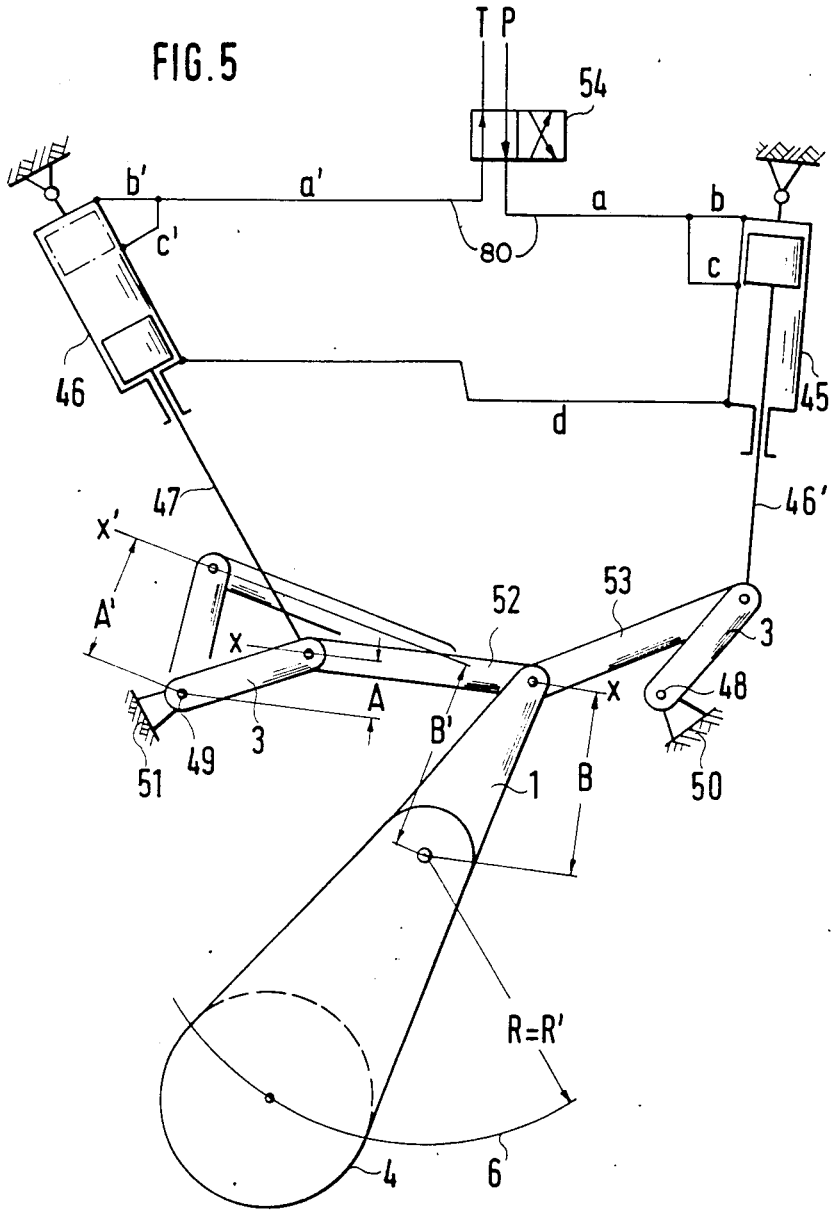
Figure 6:
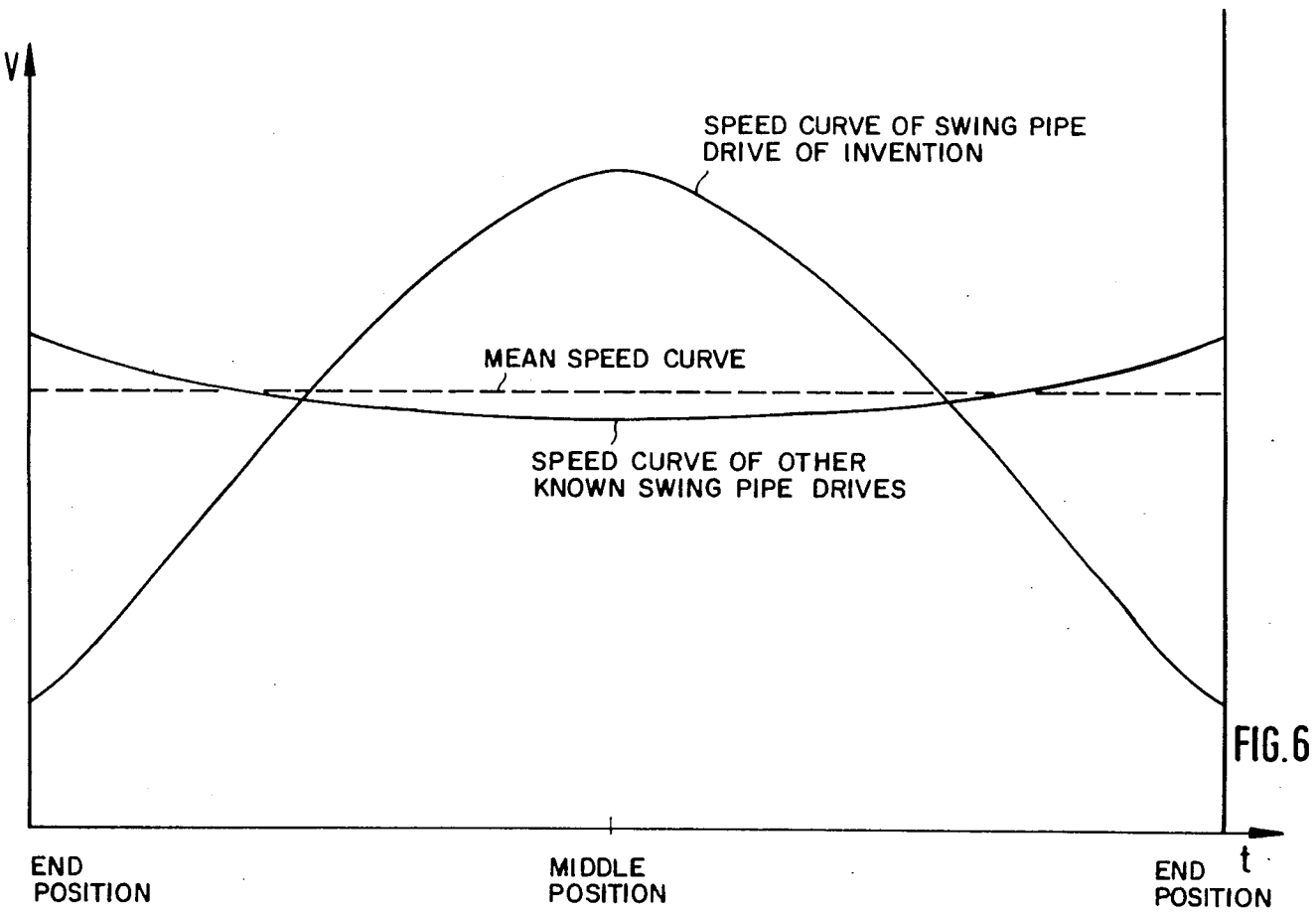

FIG. 1 is a schematic drawing, i.e. with omission of all details not required for an understanding of the invention, of the drive of a swing pipe in a viscous liquid pump according to the invention and as a first construction example, FIG. 2 corresponding to the presentation in FIG. 1, shows a construction variation of the invention in two operative conditions, FIG. 3 corresponding to the presentations in FIGS. 1 and 2, shows a further variation of the invention, FIG. 4 corresponding to the presentation in FIGS. 1 to 3, shows another construction variation of the invention in two operative conditions, FIG. 5 corresponding to FIGS. 1 to 4, shows a further construction example of the invention, showing a partial presentation of the hydraulic work cycle, and FIG. 6 is a diagram showing time and swinging path on the abscissa and the speed of the swinging movements on the ordinate, and giving the characteristic curves of known viscous liquid pumps and of the invention's pump, as well as the mean speed curve.

By means of a sliding pin drive (1) a shaft is driven, the swing axis of which penetrates the drawing plane at 2. Via a rocking lever 3' mounted on the shaft, a swing pipe 4 is switched along an arcuate swing path 5. One of the end positions is shown at 6 in FIG. 1.

The sliding pin drive is connected to a link 3 via a pair of elements. The pair of elements consists of a sleeve 7 and a rod 8, which is guided in the sleeve, which rod is constructed in one piece with the sliding pin drive. The link 3 is constructed as a ternary gear component and is permanently mounted on the frame at 10 with a further pair of elements, which form a joint and are located at the opposite end of the link 3, and which are designed as 9. Between the two pairs of elements 7, 8 or 9, respectively, is a third pair of elements 11, which is also formed as a joint. This joint serves to connect the piston rod 12 of a hydraulic working cylinder 13, which is permanently attached to the frame at 15 via a joint 14. The piston rod 12 constitutes the output of the drive formed by cylinder 13, via which output the sliding pin drive 1 is driven.

As shown in FIG. 1, the link 3 is inserted into the kinematic train from the output 12 to the sliding pin drive 1. The sliding pin drive 1, shown in its extreme left position, can be moved across the central position (shown partially) into a right end position (not shown), or it can be moved back from the latter into the left end position. Because of the design of the element pair 7, 8 the rod 8 slides continually in the sleeve 7, which is pivoted on the link 3, when the sliding pin drive 1 travels through the swing path required to reach the end position of the swing pipe. The effective lever arm of the sliding drive 1 is designed as B and the effective lever arm of the link 3 is designated as A in the end positions of the swing pipe 4, i.e. when the mechanism is in the bent position, as shown in FIG. 1; the effective lever arm of the sliding pin drive 1 is designed at B' and the effective lever arm of the link 3 is designated as A' in the center position of the swinging movement, i.e. when the mechanism is in the vertical position as shown in FIG. 1. The lever arm ratio A'/B' amounts to many times, for instance 3 to 7 times the corresponding lever arm ratio A/B of the drive. As a result, the speed of the movement of the swing pipe 4 across the swing path 6 during the back- and forth movement of the sliding pin drive 1 is changed continuously. Because of the geometry shown, the swing pipe 4 has a greater speed in the central position, which is unfavorable for the flow-back of the viscous liquid from the conveying line, than at the end of the swing movement. That is to say the speed is reduced at the ends of the swing path 6 as opposed to the average speed, which reduces stress and wear.

The construction example according to FIG. 2 is generally unchanged with respect to the arrangement of the drive, the penetration point 2 of the geometric axis of the rocking shaft, and the rocking lever 3'. However, the link 3 is located on its own rocking shaft, the geometric axis of which penetrates the geometric axis of the drawing plane at 16. The shaft is driven by means of a gearwheel or toothed segment 17, which moves on a toothed rack 18. The toothed rack connects to each of piston 19 and 20, respectively, to which one working cylinder 21 and 22, respectively, has been assigned. The working cylinder 22 moves along the motionless piston rod 23 of the piston 20, which is permanently attached to the frame at 24. Likewise, the piston rod 25 of the piston 19 is permanently frame-mounted at 26, so that the working cylinder 21 moves along the piston rod 25. For the sake of better comprehension, FIG. 2, as well as the following presentations, show the effective lever arms A of the link 3 and B of the drive pin 1. In the construction example of FIG. 2 the link 3 is also designed as a drive; it is connected with the joint 29 of the drive pin 1 by means of a coupling (shown only by a line at 27 and 28, respectively).

The construction example in FIG. 3 differs from that in FIG. 2 above all by the permanent placement of a double working cylinder 30, which is fixed to the frame at 31. Between the two pistons 32, 33 runs a toothed rack 34 as a connector, which drives the link 3, designed as a drive, via a toothed segment 35; the coupling is shown at 36.

In the construction example in FIG. 4 the drive pin 1, in turn, is connected to the link 3 via a coupling shown at 37 and 38, respectively. The link 3 is designed as a triangular shift lever. The connecting joint 39 of the coupling 37 and 38, respectively, is located in the apex of the triangle. One additional connecting joint 40 and 41, respectively, is used to connect the toggle joints 42, 43, which in turn are connected with a curved toggle joint 44, and of which joint 43 is permanently attached to the frame. In the connecting joint 45 of the toggle joints 42 and 44 is located the connection of the output piston rod 12 of the hydraulic working cylinder 13, which forms the drive of the swing pipe 4 across the swing path 6.

In the construction example in FIG. 5 two hydraulic drive cylinders 45, 46 are used to drive the swing pipe 4 across the swing path 6, which cylinders are connected with their piston rods 46', 47 to the respective free ends of the links 3, which are designed as binary components. The links 3, in turn, are permanently attached to the frame via their other element pairs, i.e. joint 48, 49 at 50 and 51. The connection of the links 3 with the drive pin 1 is achieved via couplings 52, 53, which together with the binary links 3 form a knuckle joint.

The working cylinders 45, 46 are controlled via a 2/4-way valve 54, as can be seen from the partial presentation of the hydraulic operating circuit. The two hydraulic working cylinders are connected with one another via control lines 80, so that when feeding pressure oil P, for example, to the hydraulic drive cylinder 45, the other hydraulic drive cylinder 46 is acted upon at the piston end via the freely interconnected lines a, c and d and drives the drive as far as the center position of the swing movement, whereupon a switching, i.e. blocking of the line connection c–d and opening of the line connection d–c', occurs and the hydraulic working cylinder 45, now acted upon at the piston end, drives the drive from the central position to the second end position. With the opposite swing movement, the above-described control processes are analogously reversed.

I claim:

1. In a viscous liquid pump having a pair of pumping cylinders and a swing pipe alternately connecting one pumping cylinder with a conveyor pipe and exposing the other pumping cylinder, a drive mechanism for moving the swing pipe about a pivot point in an arcuate path of travel at varying speeds along said path, said drive mechanism comprising:

hydraulic motive power means; and linkage means comprising a first lever extending from the swing pipe and a second lever (3) having one end pivotally mounted and the other end coupled to said first lever for applying force to said first lever to move the swing pipe along the arcuate path of travel, said hydraulic motive power means being coupled to said second lever, said linkage means having a first linkage distance (B) extending from the pivot point of the swing pipe to the point of force application on said first lever and measured normal to the direction of force application, said linkage means having a second linkage distance (A) between said first and second ends of said second lever and measured normal to the direction of force application, said linkage means being formed such that the ratio of the second and first linkage distances (A'/B') when said swing pipe is in the center of the arcuate path of travel is greater than the corresponding ratio (A/B) when the swing pipe is at the ends of the path of travel, thereby to provide greater speed to the swing pipe in the center of the path of travel than at the ends.

2. The drive mechanism according to claim 1 wherein said one end of said second lever (3) is pivotally mounted at a fixed position and wherein said other end of said second lever (3) is coupled to said first lever by means of a sliding pin drive including a sleeve (7) slidable along said first lever (8).

3. The drive mechanism according to claim 1 wherein said second lever (3) is formed as a triangular lever having a first corner (41) pivotally mounted at a fixed location, a second corner (40) coupled to said hydraulic motive power means, and a third corner (39) connected to said first lever via a coupling bar (37).

4. The drive mechanism according to claim 1 wherein said second lever (3) is mounted to a rotatable shaft so that said second end moves in an arcuate path, said second end of said second lever being coupled to said first lever by a coupling bar (36); said hydraulic motive power means being coupled to said shaft for rotating same.

5. The drive mechanism according to claim 1 wherein said second lever (3) is mounted on a member (17) performing a rolling motion providing combined linear and rotary movement to said second lever, said hydraulic motive power means being coupled to said member for providing said rolling motion, said second end of said second lever being coupld to said first lever by a coupling bar (27).

6. The drive mechanism according to claim 1 wherein said drive mechanism includes a pair of second levers (3), each of said second levers having one end pivotally mounted at a fixed location and a second end coupled to said first lever by a coupling bar (53, 54), the coupling bars extending in opposing directions from said first lever, said hydraulic motive power means (45, 46) having means coupled to each of said second levers for moving the swing pipe.

7. The drive mechanism according to claim 6 wherein said hydraulic motive power means has a pair of hydraulic motors, one of said motors being coupled to each of said second levers, said hydraulic motive power means having hydraulic circuitry interconnecting said hydraulic motors such that one motor operates said drive mechanism to move the swing pipe from one end position to a central position and the other hydraulic motor operates said drive mechanism to move the swing pipe from the central position to the other end position.

* * * * *